United States Patent [19]

Halverson

[11] Patent Number: 4,710,777

[45] Date of Patent: Dec. 1, 1987

[54] DISH ANTENNA STRUCTURE

[75] Inventor: Ross Halverson, Lone Rock, Wis.

[73] Assignee: Kaultronics, Inc., Richland Center, Wis.

[21] Appl. No.: 694,435

[22] Filed: Jan. 24, 1985

[51] Int. Cl.[4] ..... H01Q 15/16

[52] U.S. Cl. ..... 343/840; 343/912

[58] Field of Search ..... 343/840, 912–916, 343/873, 878

[56] References Cited

U.S. PATENT DOCUMENTS

| | | | |
|---|---|---|---|
| 3,165,751 | 1/1965 | Clark | 343/915 |
| 3,234,550 | 2/1966 | Thomas | 343/912 |
| 3,235,872 | 2/1966 | Schepis | 343/912 |
| 3,406,404 | 10/1968 | Maier | 343/915 |
| 3,543,278 | 11/1970 | Payne | 343/915 |
| 3,832,717 | 8/1974 | Taggart, Jr. | 343/840 |
| 3,971,023 | 7/1976 | Taggart | 343/840 |
| 4,201,991 | 5/1980 | Vines | 343/915 |
| 4,268,835 | 5/1981 | Taggart | 343/915 |
| 4,378,561 | 3/1983 | Hibbard et al. | 343/912 |
| 4,458,251 | 7/1984 | Bondon | 343/914 |
| 4,506,271 | 5/1985 | Gonzalez | 343/915 |
| 4,528,569 | 7/1985 | Felter et al. | 343/840 |
| 4,568,945 | 2/1986 | Winegard et al. | 343/916 |
| 4,578,682 | 3/1986 | Hooper et al. | 343/916 |

*Primary Examiner*—Eli Lieberman
*Assistant Examiner*—Michael C. Wimer
*Attorney, Agent, or Firm*—Isaksen, Lathrop, Esch, Hart & Clark

[57] ABSTRACT

A dish antenna structure (10) is formed from a plurality of ribs (14) which extend from near the center of the dish to its periphery, and which support antenna panels (18) between them. Each rib has an outer flexible plastic sheath having grooves (44,45) in its side edges which receive the edges of antenna panels (18) and a hollow longitudinal channel (40) within which a rigid support member (42) is fixed. The support ribs (14) and the antenna panels (18) are curved such that the anterior surface of the dish defined thereby is parabolic.

21 Claims, 8 Drawing Figures

DISH ANTENNA STRUCTURE

BACKGROUND OF THE INVENTION

1. Field of Invention

This invention relates to antennas adapted to receive transmissions from communication satellites which orbit the earth, and in particular to dish antennas.

2. Background Art

The antenna dish provides a relatively wide surface for capturing satellite radio frequency transmissions and is often shaped parabolically to focus parallel intercepted microwaves upon a pickup probe to provide an augmented signal to the antenna user. Such shaped dishes have commonly been formed of stamped sheet metal (e.g., aluminum or stainless steel), either as one piece units or, for larger antennas, of multiple parts that are assembled on site. Dish antennas have also been formed from a plurality of wedged-shaped antenna sections of metal mesh which are capable of reflecting the transmitted radio waves and which are supported in the dish shape by rigid radial ribs. The ribs are appropriately shaped such that the antenna sections are held in position to form a parabolic surface. Dish antennas formed of sections of metal mesh allow light to pass therethrough, and thus may be more aesthetically acceptable than a solid sheet metal antenna. The metal mesh also allows air to pass through, resulting in a lower wind load than would exist in a solid antenna of the same size. A particular advantage of mesh antennas over solid metal dishes is that the mesh antenna can be shipped in pieces in compact packages whereas the solid dishes are extremely large and bulky, requiring special handling procedures, and consequently are expensive to ship.

While the performance of mesh antennas is generally comparable to solid dish antennas, it has been found that the supportive rigid ribs, which are made of metal, are capable themselves of reflecting microwaves. The surface of the metal rib section at the joint where the rib engages the mesh is typically displaced from the surface of the mesh. As a consequence, the microwaves reflected from the metal ribs may be slightly out of phase with the microwaves reflected from the metal surface. Because the supporting ribs must be of high strength and resistant to corrosion when exposed to weather, the ribs have typically been constructed of expensive high strength aluminum or stainless steel.

It is desirable to connect the antenna mesh sections to the supportive ribs without unduly stressing the mesh sections. Connection has been accomplished by fitting the edges of the mesh sections into longitudinal grooves located along the metal ribs. However, the panels generally cannot be tightly fit into the grooves in the metal ribs, and connectors, such as screws, are required to hold the mesh to the ribs.

SUMMARY OF THE INVENTION

The dish antenna structure of the present invention has wedge-shaped and sheet-like antenna panels, preferably formed of metal mesh, and radial support ribs which firmly engage the edges of the antenna panels to hold the same in the desired dish configuration. Each of the radial support ribs has an outer sheath of plastic material, e.g., polyvinyl chloride, which is flexible, resilient, and resistant to weathering by exposure to rain, wind and sunlight. Structural rigidity and strength is provided to the rib structure by an inner metal, preferably steel, support member held within a channel in the outer sheath. The metal member provides high strength and rigid support for the entire rib structure, enabling the rib to be produced at relatively low cost. Since the outer plastic sheath protects the inner metal member from contact with rain, the metal need not be corrosion resistant, and may be a common and inexpensive structural material, such as mild steel.

In a preferred form, the side edges of the rib sheaths have longintudinal grooves sized to admit the side edges of the wedge-shaped antenna panels and tightly engage the same without requiring other connectors.

The radially extending ribs are joined at their inner ends to a central support hub, which itself is preferably parabolically shaped, and are connected at their outer ends to a circular, peripheral ring, formed of a rigid, corrosion-resistant material such as aluminum, which is attached to the end of each radial rib and holds the same firmly in the desired position in the dish.

A particular advantage of the rib construction of the present invention is that the material of the rib sheath is transparent to microwaves. Thus, microwaves incident on the portion of the rib sheath which extends above the adjacent mesh panel will pass through the rib sheath and reflect off the panel, with no substantial difference in the phase of the reflected microwave off the panel under a portion of the sheath from microwaves reflected off of adjacent portions of the panels. The edges of adjacent panels fitted into the grooves in a rib terminate at positions closely adjacent to one another, with only a small break between the adjacent panels. Thus there is only a very limited amount of phase distortion of the reflected microwaves occurring because of this spaced joint.

Further objects, features and advantages of the invention will be apparent from the following detailed description when taken in conjunction with the accompanying drawings.

DESCRIPTION OF THE PREFERRED EMBODIMENT

Figure 1:
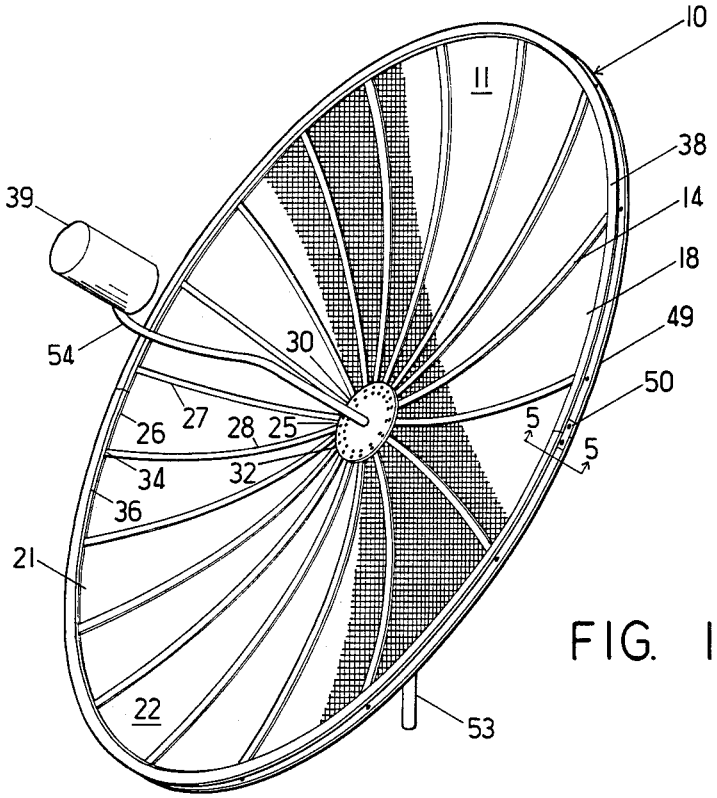
FIG. 1 is a perspective view of an installed dish antenna structure in accordance with the invention.
Figure 6:
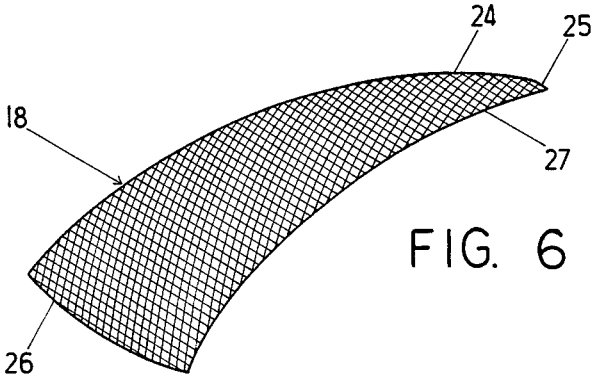
FIG. 6 is a perspective view of one wedge-shaped reflective mesh panel.
Figure 7:
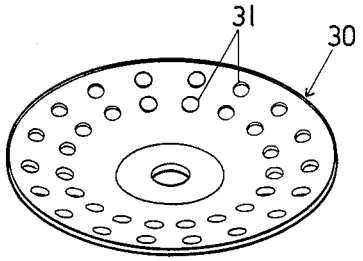
FIG. 7 is a perspective view of the central support hub.
Figure 8:
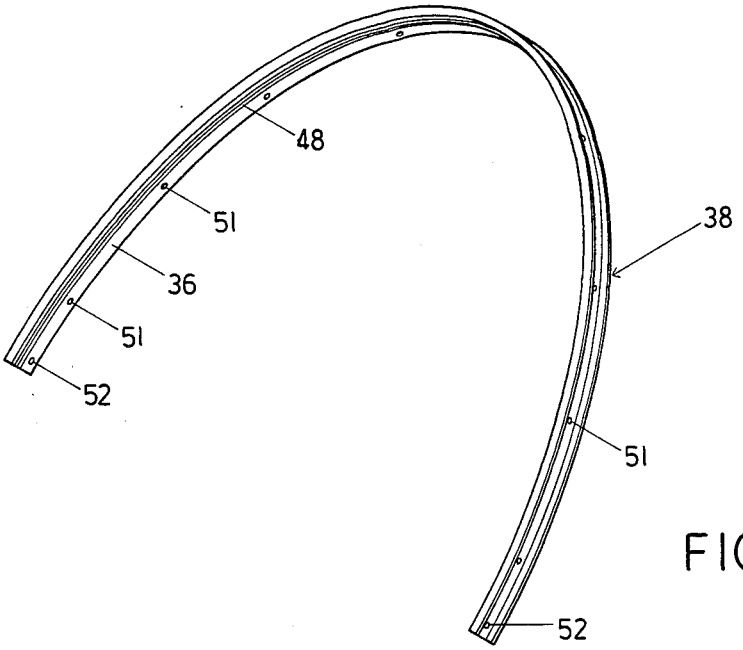
FIG. 8 is a perspective view of a section of the outer peripheral ring portion of the antenna.

With reference to the drawings, a preferred embodiment for a dish antenna structure constructed in accordance with the invention is shown generally at 10 in FIG. 1. The structural elements of the preferred dish antenna structure 10 include a plurality of uniformly constructed ribs 14 of selected length and a plurality of sheet-like antenna panels 18 also uniformly constructed. The ribs 14 and the antenna panels 18 are alternately spaced in a generally radial manner to form a dish 21. The dish has an anterior surface 11 adapted to face a transmitter, such as a communications satellite, and a central axis adapted to symmetrically align a central point on the dish with the transmitter. Each antenna panel 18 is preferably wedge-shaped, as best shown in FIG. 6, having a front surface 22 generally forming the anterior surface 11 of the antenna, a rear surface 24 oriented away from the anterior surface, an inner edge 25, an outer edge 26, and two opposed side edges 27 and 28.

Each rib 14 has an inner end 32 and an outer end 34. As best shown in FIG. 1, the inner ends 32 of all ribs are preferably coplanar where they are joined to a central support hub 30. In the preferred embodiment the hub plate 30 has holes 31 which are used to bolt the ribs in place, as is more fully explained below. Other means for centrally supporting the ribs, such as fixing the ribs to a central ring, will be evident to those skilled in the art. Each rib 14 extends outward in a generally radial direction from the hub 30. The hub 30 is curved, preferably in a parabolic fashion. The outer end 34 of each rib 14 is oriented away from the central support hub and is secured to the inner surface 36 of a circular peripheral ring 38.

Each antenna panel 18 is located with its inner edge 25 toward the support hub 30, its outer edge 26 away from the support hub, and its two opposed side edges 27 and 28 each oriented toward an adjacent rib 14. The antenna panels 18 are curved such that the anterior surface 11 defined by the front surfaces of the panels is generally concave. Preferably, each rib 14 is bent in a parabolic curve, the antenna panels 18 are shaped in sectors of a parabolic surface, and the dish anterior surface 11 is thus generally parabolic. This enables the antenna to most efficiently reflect and focus incoming radio frequency transmissions upon a point at which a pickup probe 39 may be located.

Figure 2:
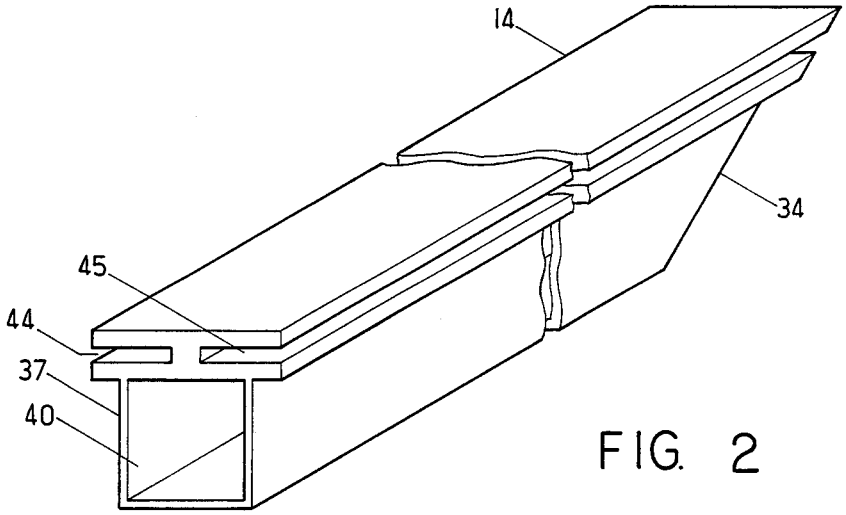
FIG. 2 is a perspective view of a rib sheath lying straight with its rearward end angled.
Figure 3:
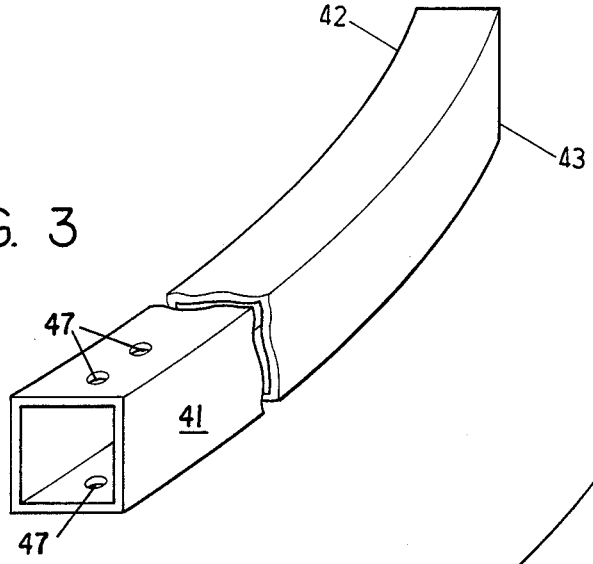
FIG. 3 is a perspective view of an inner support member for a rib, curved parabolically with its rearward end angled.
Figure 4:
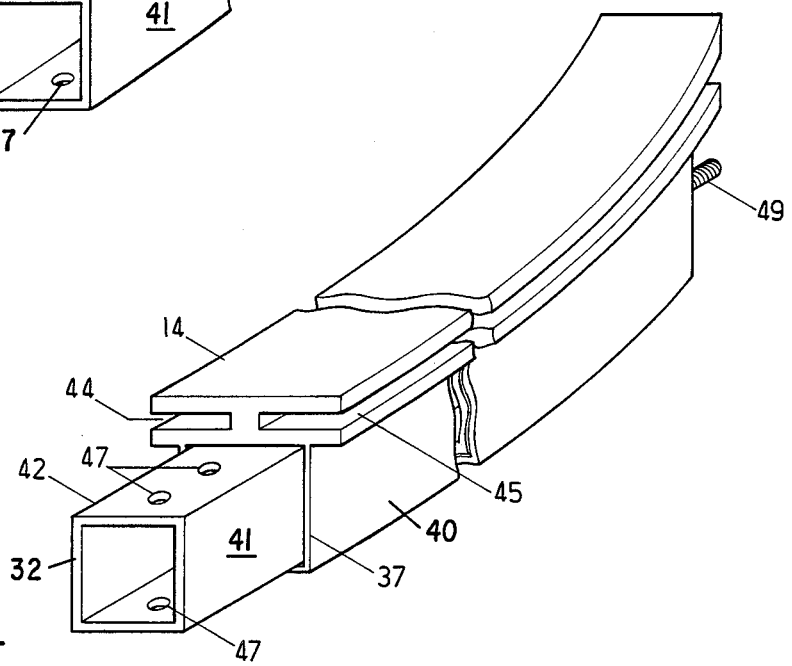
FIG. 4 is a perspective view of a flexible rib supported in a curved position by a curved support member, the rearward ends of the rib and the support member being angled.

As shown in FIG. 2, each rib 14 in the preferred embodiment has a sheath 37 which has an inner hollow longitudinal channel 40 along the length of the rib. A rigid support member 42 may be fitted within the support channel 40 to strengthen the rib 14, as shown in FIG. 4, and to restrict the longitudinal flexibility of the rib. As shown in FIG. 3, the support member 42 may be bent, preferably in a parabolic curve, to define the curvature of the surrounding sheath 37.

Figure 5:
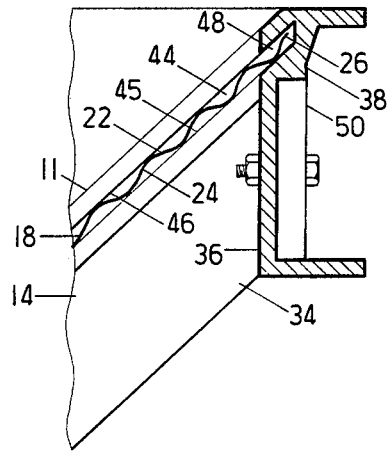
FIG. 5 is a cross section along line 5—5 of FIG. 1 showing a portion of an antenna section engaged by both a rib groove and a peripheral ring groove, and showing a ring segment connector.

The support member 42 is constructed of a strong material, such as steel, which provides most of the structural support for the dish antenna structure. As shown in FIG. 4, a first end 41 of the support member 42 may extend outward from the support channel 40 at its inner end and includes holes 47 through which the support member may be bolted to the hub 30. The inner end 32 of each rib 14 may thus be secured to the hub 30 by using the support member 42. In the preferred embodiment of the rib 14, rib grooves 44 are located longitudinally along the length of the ribs 14 and are used to connect the ribs to the antenna panels 18. The side edges 27 and 28 of an antenna panel 18 are respectively received by the rib grooves 44 of adjacent ribs. Each rib groove 44 has a bottom wall 45 and an opposed top wall 46 which engage the antenna panels 18 to hold the panels within the rib grooves, as shown in FIG. 5. Because the outer sheath of the rib is formed of a material (e.g., polyvinyl chloride) which is flexible and resilient, the rib groove walls can tightly engage the edges of the antenna panels inserted into the grooves. In the preferred embodiment, both the support channel 40 and the support member 42 are rectangular in cross section, with one face of the rectangle underlying a portion of the groove bottom walls 45 in parallel relation. Thus, a laterally straight border of the support channel 40 underlies a portion of groove bottom wall 45, and a rigid, laterally straight surface of the support member 42 underlies and supports the groove bottom wall 45, thereby enhancing the tightness with which the antenna panel side edges 27 and 28 may be engaged.

As shown in FIGS. 2, 4 and 5, the outer end 34 of the rib 14 is preferably angled. Similarly, the second end 43 of the support member 42 is also angled. As shown best in FIG. 5, the ends 34 and 43 are angled such that they generally meet the inner surface 36 of the peripheral ring. As also shown in FIG. 5, the ring 38 preferably has a peripheral ring groove 48 which receives and holds the outer edges 26 of the antenna panels 18. The ends of the ribs 14 may also be secured to the peripheral ring 38. In the preferred embodiment a bolt 49 is affixed to the outer end 34 of each rib and extends through support holes 51 located in the peripheral ring 38 at its junction with each rib 14 and is engaged with a nut to secure the rib in place.

The sheath of the rib 14 is made of a material which is transparent to microwaves. Because the rib sheaths are transparent to microwaves, the distortion of the microwave signal reflected by the dish is minimized. As shown in FIGS. 2 and 4, the opposed rib grooves 44 closely approach each other so that the edge 27 of one antenna panel engaged in a groove on one side of the rib terminates at a position closely adjacent to the edge 28 of the adjacent antenna panel engaged in the groove on the other side of the rib. This arrangement minimizes the spacing between the edges of the panels and the distortion produced by microwaves which might pass through the gap between the edges of adjacent antenna panels and reflect from the inner support member 42 to the pick up probe 39. Since the material of the sheath above the edges of the antenna panels is transparent to microwaves, it does not introduce phase distortions in the reflected signals.

The rib sheath 37 is also preferably corrosion resistant and waterproof, allowing the inner support member 42 to be constructed of strong but corrosion prone materials such as steel. In the preferred embodiment, the rib sheath is made from polyvinyl chloride, and the support members are made from steel.

The peripheral ring 38 may be formed in segments, allowing more convenient shipment, and in the preferred embodiment is constructed in two segments which are joined by segment connectors 50 bolted to both segments using bolt holes 52 and spanning the joint between them. The peripheral ring segments 38 are preferably constructed of a rigid, corrosion resistant material such as aluminum.

The antenna panels 18 are preferably constructed of an expanded, flattened, aluminum mesh. Other suitable materials may be substituted. For example, stainless steel mesh or other corrosion resistant material capable of reflecting microwaves may also be used for the antenna panels.

As shown in FIG. 1, the preferred embodiment includes a mounting bar 53 which is rotatably mounted to the hub 30 such that, when the mounting bar is fixed in position in the ground, the orientation of the dish may be adjusted. The antenna also includes a probe mount 54 secured to the central hub 30 and extending therefrom such that the pickup probe 39 may be located on the probe mount in a position to effectively receive microwaves reflected from the antenna sections.

While the dish antenna structure is shown assembled in FIG. 1, it is commonly shipped to the user's location in kit form. Each part in the kit is, of course, adapted to relate to the others as described above.

The outer sheath 37 can be formed from a continuous plastic extrusion having the cross-sectional shape shown in FIG. 2 and can be cut to the desired lengths for the ribs. The extruded plastic sheaths are formed straight but the sheath is sufficiently flexible to assume the curve of the support member 42 as the support member is inserted into the support channel 40. The support member 42 itself may be formed of straight hollow tube stock which is bent to a selected parabolic curvature in a press. The step of extruding the rib sheath is preferably carried out using a commercially available apparatus for extruding plastic such as polyvinyl chloride. The bent support members 42 may be manually inserted into the straight rib sheaths which distort as the support member is inserted to assume the desired parabolic shape for the rib.

It is understood that the invention is not confined to the particular construction and arrangement of parts herein illustrated and described, but embraces such modified forms thereof as come within the scope of the following claims.

What is claimed is:

1. A dish antenna for receiving transmissions from a transmitter such as a communications satellite comprising:

(a) a plurality of support ribs of selected length spaced in a radial manner and central support means for engaging and supporting the ribs, each rib having an inner end secured to the central support means and an outer end oriented away from the central support means, each rib comprising an outer sheath of flexible resilient plastic material transparent to microwaves having grooves along the side edges thereof defined by top and bottom walls, a hollow channel in the sheath extending along its length beneath the grooves therein, and a rigid support member within the channel in the sheath to provide structural support therefor;

(b) a plurality of antenna panels engaged between the ribs to form a dish having an anterior surface adapted to face the transmitter and a central axis adapted to symmetrically align a central point on the dish with the transmitter, each antenna panel formed of a microwave reflecting material and having a front surface, a rear surface, an inner edge oriented toward the central support means, an outer edge oriented away from the central support means, and opposed side edges extending between the inner edge and the outer edge of the panel, the opposed side edges of each panel received in the edge grooves of adjacent ribs such that the side edges of the panels are held between the top and bottom walls of the grooves, the front surface of each antenna panel being curved such that the anterior surface of the antenna as defined by the front surfaces of the panels is concave.

2. The dish antenna of claim 1 further including a peripheral ring which is generally round and has an inner surface generally oriented toward the central support means; and wherein each rib is of equal length and is generally coplanar with the central axis; and wherein the outer ends of the ribs are secured to the inner surface of the peripheral ring.

3. The dish antenna of claim 2 wherein the peripheral ring has ring grooves which receive the outer edges of the antenna panels.

4. The dish antenna of claim 1 wherein the opposed rib grooves of each rib closely approach each other; and wherein the edge of the antenna panel engaged by one groove of each rib terminates close to the edge of the antenna panel engaged by the second groove of the rib so that the transmissions which pass between the adjacent edges are minimized.

5. The dish antenna of claim 1 wherein the rib sheath is constructed of polyvinyl chloride plastic.

6. The dish antenna of claim 1 wherein the antenna panels are constructed of stainless steel mesh.

7. The dish antenna of claim 1 wherein the antenna panels are formed of an expanded, flattened aluminum mesh.

8. The dish antenna of claim 1 wherein the rib support members are made of steel.

9. The dish antenna of claim 1 wherein the central support means is a metal hub plate with a parabolic surface; wherein each rib is bent in a parabolic curve; wherein each antenna panel has a front surface forming a sector of a parabolic surface; and wherein the anterior surface of the dish as defined by the antenna panel front surfaces is generally parabolic.

10. The dish antenna of claim 1 wherein the channel in each rib sheath has laterally straight borders that underlie a portion of the groove bottom walls in parallel relation; and wherein the support members have rigid laterally straight surfaces that underlie and support the groove bottom wall.

11. A support rib adapted for use in a dish antenna structure comprising:

(a) an outer sheath of flexible, resilient plastic material transparent to microwaves, having grooves along the side edges thereof defined by top and bottom walls, and an inner hollow channel in the sheath extending along its length beneath the grooves therein; and (b) a rigid inner support member fitted within the inner channel in the sheath to strengthen the rib and limit the longitudinal flexibility of the rib.

12. The support rib of claim 11 wherein the channel in the sheath and the support member are both rectangular in cross section with one side of the support member underlying a portion of the groove bottom wall.

13. The support rib of claim 11 wherein the rib sheath is formed of polyvinyl chloride.

14. The support rib of claim 11 wherein the support member is made of steel.

15. A kit for making a dish antenna structure comprising the combination of:

(a) a central hub;

(b) a plurality of peripheral ring segments adapted to be joined to form a round, peripheral ring which has an inner surface with a radius larger than the hub;

(c) a plurality of support ribs adapted to be spaced in a radial manner around the central hub, each having an inner end adapted to be secured to the hub and an outer end adapted to be secured to the peripheral ring, an outer sheath of flexible, resilient plastic material transparent to microwaves, having grooves along the side edges thereof defined by top and bottom walls, a hollow channel in the sheath extending along its length beneath the grooves therein, and a rigid support member within the channel in the sheath to provide structural support therefor;

(d) a plurality of antenna panels adapted to be engaged between the ribs to form a dish having an anterior surface adapted to face a transmitter and a central axis adapted to symmetrically align a central point on the dish with the transmitter, each antenna panel having a front surface, an inner edge adapted to be oriented toward the hub, an outer edge adapted to be oriented toward the peripheral ring and opposed side edges extending between the inner edge and the outer edge and adapted to be received by the edge grooves of adjacent ribs;

(e) means for securing each rib to the hub; and (f) means for securing each rib to the peripheral ring.

16. The kit of claim 15 wherein each rib is of equal selected length and is adapted to extend from the hub to the peripheral ring; and wherein the front surface of each antenna panel is curved such that the anterior surface of the dish is concave.

17. The kit of claim 16 wherein the hub has a parabolic surface; wherein each antenna panel is curved to form a sector of a parabolic surface, wherein the support ribs are curved parabolically, and wherein the peripheral ring has a groove in its inner surface adapted to receive the outer edges of the antenna panels.

18. The kit of claim 15 wherein two rib grooves of each rib closely approach each other; and wherein the edges of the adjacent antenna panels are adapted to be held within the two grooves of each rib such that they terminate close to each other.

19. The kit of claim 17 further including a probe mount adapted to be secured to the central hub and to extend anteriorly therefrom; and a pickup probe adapted to be located on the probe mount in a position to effectively receive transmissions reflected from the antenna panels.

20. The kit of claim 16 further including a mounting bar which is adapted to mount to the hub to support the dish.

21. A method of forming radial dish support ribs comprising the steps of:

(a) providing a straight but flexible plastic rib sheath which has an inner longitudinal hollow channel therein along the length thereof;

(b) providing a rigid metallic support member which is fitted for insertion into the inner channel in the sheath;

(c) bending the support member to a selected generally parabolic curvature; and (d) inserting the support member into the inner channel in the sheath, thereby curving the sheath to form a rib in the desired parabolic shape.

* * * * *